United States Patent [19]

Parker

[11] 4,329,690

[45] May 11, 1982

[54] MULTIPLE SHIPBOARD ANTENNA CONFIGURATION

[75] Inventor: Ernest G. Parker, Morristown, N.J.

[73] Assignee: International Telephone and Telegraph Corporation, New York, N.Y.

[21] Appl. No.: 141,037

[22] Filed: Apr. 17, 1980

Related U.S. Application Data

[63] Continuation of Ser. No. 959,801, Nov. 13, 1978, abandoned.

[51] Int. Cl.[3] ..... H01Q 1/34; H01Q 21/28

[52] U.S. Cl. ..... 343/709; 343/725; 343/885

[58] Field of Search ..... 343/709, 724–730, 343/720, 885

[56] References Cited

U.S. PATENT DOCUMENTS

| | | | |
|---|---|---|---|
| 3,428,923 | 2/1969 | Webb | 343/885 |
| 3,555,552 | 1/1971 | Alford | 343/726 |
| 3,945,013 | 3/1979 | Brunner et al. | 343/729 |

*Primary Examiner*—Eli Lieberman

*Attorney, Agent, or Firm*—John T. O'Halloran; Peter C. Van Der Sluys

[57] ABSTRACT

A multiple antenna system for a ship mast top with the individual antenna sections being in stacked relationship. The uppermost antenna is a Global Positioning System antenna. The intermediary antenna is a Tactical Air Navigation antenna. The lowermost antenna is a Joint Tactical Information Distribution System antenna. Isolation between antennas is provided in the form of decoupling chokes which permit the individual systems to run freely.

6 Claims, 8 Drawing Figures

MULTIPLE SHIPBOARD ANTENNA CONFIGURATION

This is a continuation of application Ser. No. 959,801, filed Nov. 13, 1978, now abandoned.

BACKGROUND OF THE INVENTION

As a result of the many different Navy ships and classifications thereof, particularly the purpose and objective of each, different antenna systems or combinations thereof are applicable to each. For example, the amphibious and command group include classes of ships capable of directing or launching air operations and are therefore fitted with Tacan (Tactical Air Navigation). GPS (Global Positioning System) is planned for all ships. Most ships have multiple antenna configurations integral with search radar antennas.

Thus, it would prove extremely advantageous to combine and consolidate antenna functions in a single integrated unit without impairment of the operation of each.

Towards this end, an electronically scanned, light weight Tacan antenna has recently been developed and it has been evaluated for shipboard use. It offers the advantages of multi-function use and is adaptable for incorporation in an integrated design. It is also very suitable for stacking where it may be subjected to heavy wind and environmental loads.

SUMMARY OF THE INVENTION

Accordingly, it is a principal object of this invention to combine separately fed antennas in a single mast mounting structure while achieving sufficient isolation between antennas to permit the individual systems to run freely.

Another object is to provide an integrated light-weight, compact, antenna configuration of the foregoing type for mast top installation that takes advantage of the recently developed, light-weight Tacan antenna and its ability to be stacked along with a similarly new antenna having JTIDS (Joint Tactical Information Distribution System) application and even a third antenna which may include either a GPS or another antenna suitable for the particular accommodating classification of ship.

A further object is to provide a multi-function antenna configuration of the foregoing type in which the individual antenna functions are isolated and adapted to run freely without interference from one another notwithstanding the severe environmental and stress conditions to which they are exposed at mast top.

Other objects and advantages will become apparent from the following detailed description which is to be taken in conjunction with the accompanying drawings.

FIG. *2a* is an enlarged fragmentary sectional view of a circular decoupling choke disposed around the GPS antenna;

FIG. *2b* is an enlarged fragmentary view of the circular choke sections at the periphery of the junction of the GPS and Tacan antennas.

Figure 3:
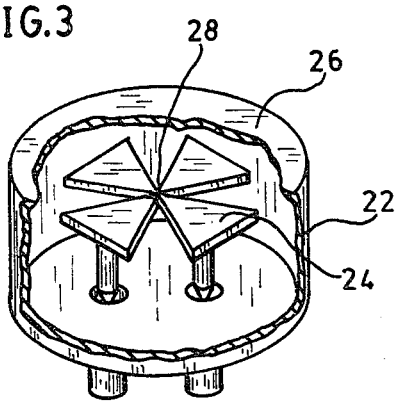
Figure 1:
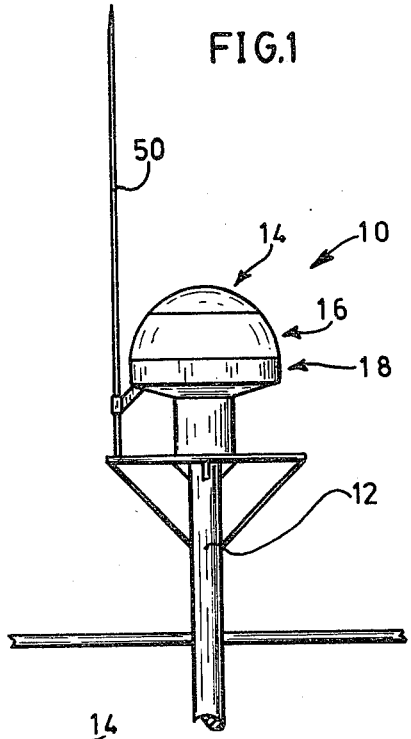
FIG. 1 is a schematic view of a ship with mast mounted multiple antenna system incorporating the teachings of the present invention.
Figure 2:
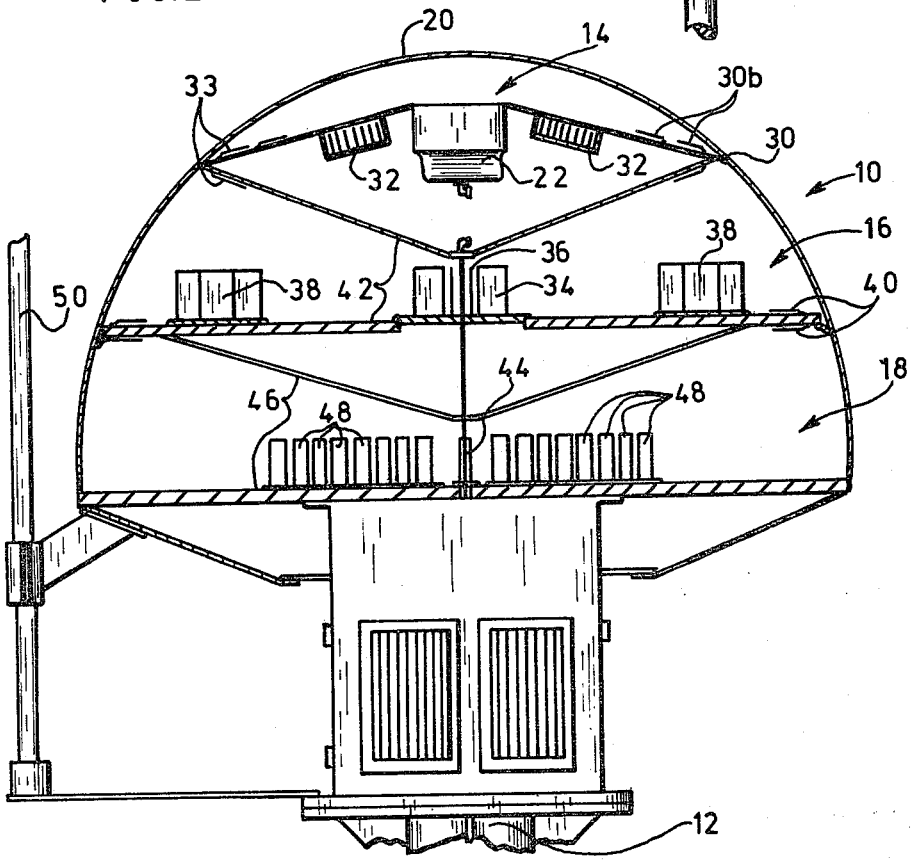
FIG. 2 is a diagrammatic side elevational view of this system showing three stacked antennas.
Figure 2A:
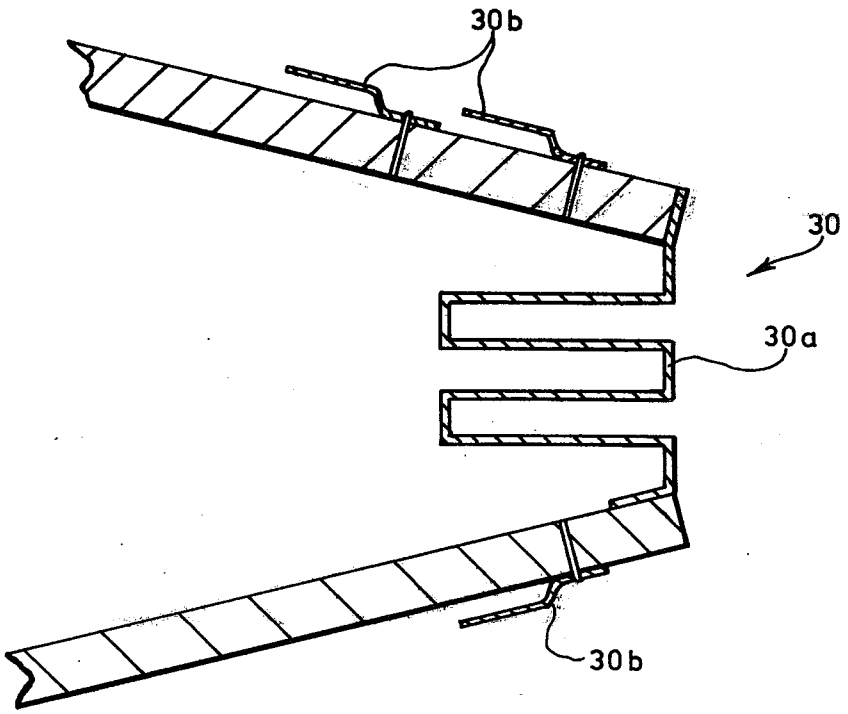
Figure 6:
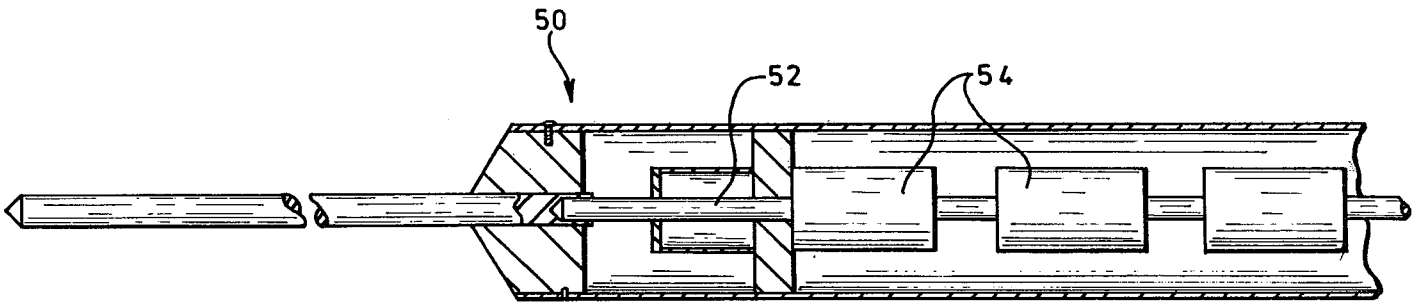
Figure 4:
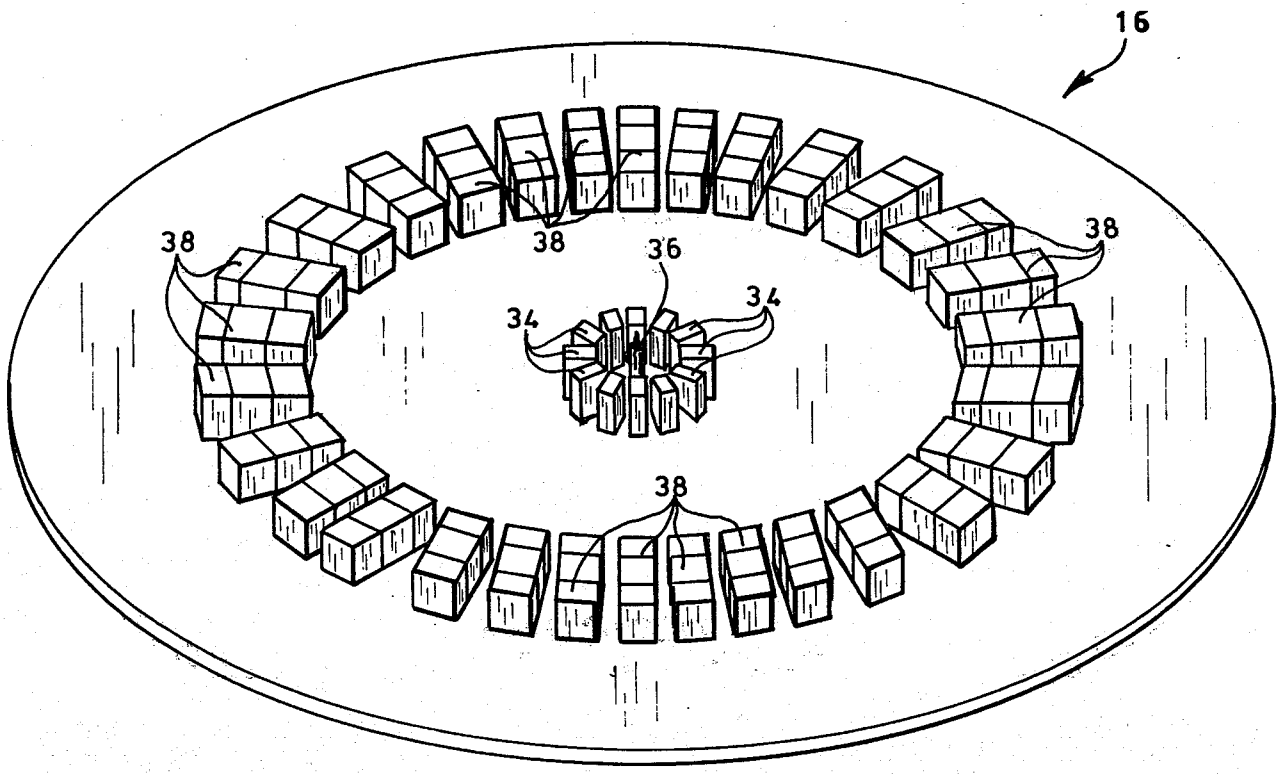
Figure 5:
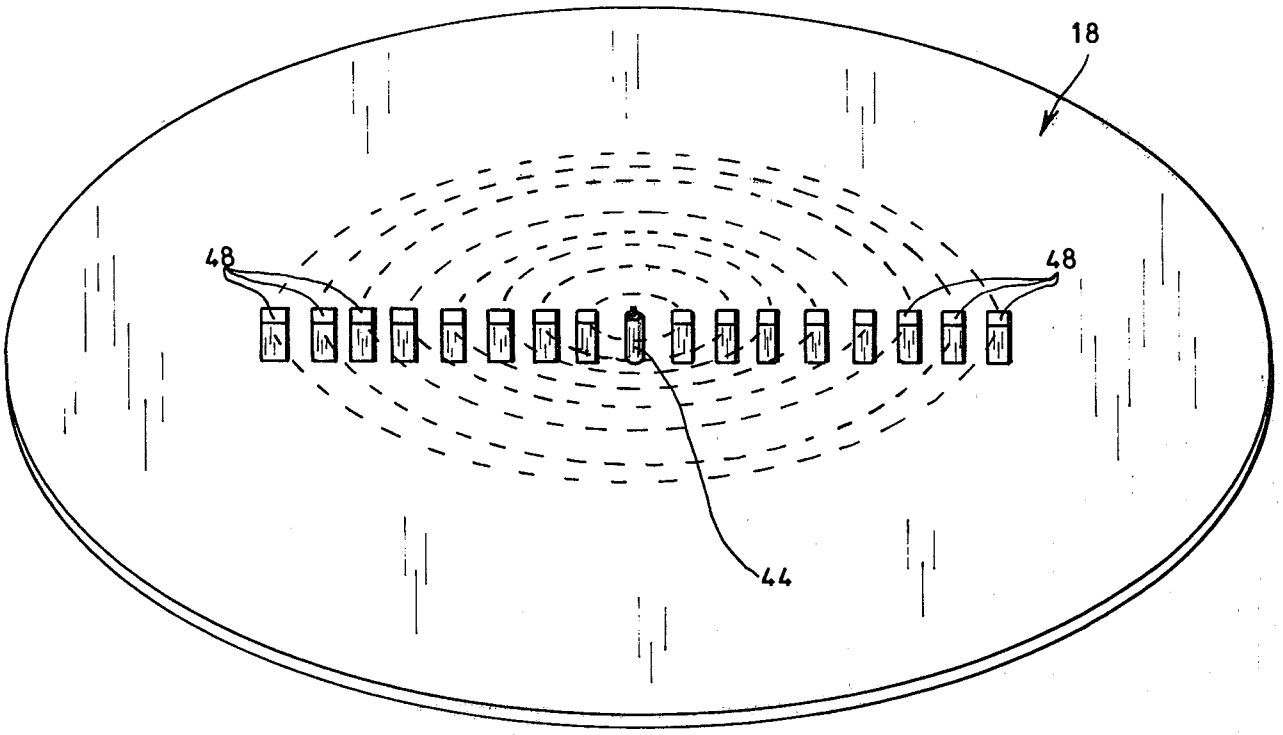

FIG. 3 is a schematic perspective view of the GPS antenna forming part of the antenna system;

FIG. 4 is a schematic perspective view of the Tacan antenna forming part of the antenna system;

FIG. 5 is a schematic perspective plan view of the JTIDS antenna forming part of the antenna system;

FIG. 6 is a diagrammatic elevational view partly in section of a lighting protector.

In the drawings, a combined GPS, Tacan and JTIDS antenna system 10 is shown located and suitably mounted on a ship mast 12. The GPS antenna 14 is uppermost and on the section accommodating the Tacan antenna 16. The JTIDS is lowermost and immediately beneath the Tacan section.

GPS-GLOBAL POSITIONING SYSTEM

GPS operates on high altitude earth satellites transmitting at relatively low power levels. Accordingly there exists a need for zenith coverage. Also, the range variation between the satellites at the zenith and horizon is small, resulting in less than 3 dB variation in received signal power. The GPS system can tolerate long interruptions of signals (depending upon the accuracy of the system clock and dead-reckoning capability). Also the satellite ephemeris-data received for navigation solution is repeated every 36 seconds, and there is no permanent loss of information. In general, four satellites must be tracked for a 3-D position fix plus recovery of system time. There are, however, degraded modes of operation using fewer satellites. One pertinent mode requiring only three satellites provides for a 2-D (latitude-longitude) position fix and recovery of system time. In this mode, the optimum satellite geometry (relative to the user) consists of tracking satellites nearest the horizon, thus relieving the instruments for zenith coverage.

The GPS is a receive-only continuous (CW) signal, spread spectrum radio navigation system operating at L-band. In the ultimate configuration, 24 earth satellites in approximately 12,000 mile altitude orbit will provide navigation capability by any number of users. Continuous position fixing is achieved by range tracking (in general) for satellites. Each satellite also transmits its orbit parameters (for calculating the satellite position as a funcion time) which when used in conjunction with the range measurements allow the users position (lat-long-altitude) and system time of day to be calculated.

The patterns of the GPS coverage require almost uniform coverage from the horizon to zenith. Again because of ships roll, coverage must be extended to 30° below the horizon.

This antenna is designed to provide uniform circularly polarized coverage in the upper hemisphere. Pattern shaping is required to reduce illumination of the ocean surface and provide isolation from other systems on the ship. Isolation is important to the operation of this system because of the high sensitivity of the GPS receiver. Towards this end, it is contemplated that the receiver front end will be incorporated along with the antenna.

It should be understood that the GPS antenna 14 and the specifics thereof do not per se constitute part of the present invention. A suitable hemispherical, circularly polarized antenna (which may be required to be scaled in frequency) is available from American Electronic Laboratory, Colmar, Pa.

In the illustrated embodiment the outer configuration 20 of the antenna is hemispherical. A substantially hemispherical aperture of selected predetermined radius is provided for this antenna to provide the radiation and isolation characteristics at its assigned frequency of 1227 and 1575 MHz. A wave guide section 22 below cut-off serves as the housing for the antenna. Within the housing are located two, orthogonally disposed loop radiators which are coaxially fed. These radiators are resonated to free-space via a dielectric window 26. The two loop radiators 24 are located at the same distance with respect to the dielectric window. Each radiator is tapered, with the wide dimensions at the extremes and the narrow dimensions at the center. In the cross-over region 28, one loop is "dimpled" under and the other is over the plane of the loops. In this manner the conductors do not touch physically and maintain equal electrical length to satisfy matching requirements.

Figure 2B:
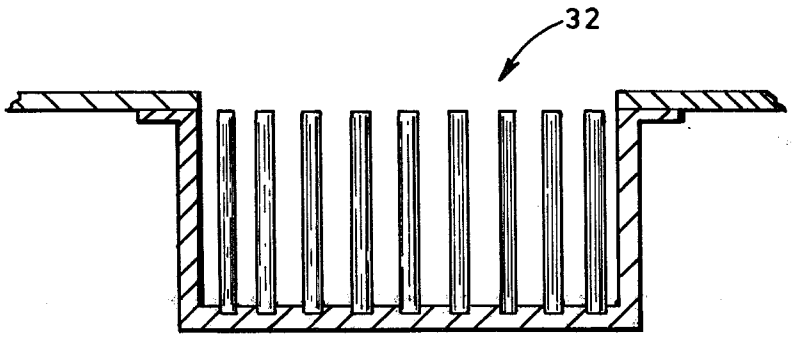

Because of the high sensitivity of the GPS receiver, some additional protection beyond the assumed 30 dB antenna isolation will be required. To improve the isolation between the system, circular choke sections 30 are utilized between the antennas. In this connection, several circular chokes 30*a* and 30*b* are shown together but each may be used individually or in any combination. The degree of separation and number of cavities of choke 30*a* will be dictated by the specific application. The depth of the cavities will normally be $\frac{1}{4}$ wave length. The circular chokes 30*b* may be used individually at the periphery of each cone or in pairs as shown. In either event the cavity depth of each choke 30*b* will be approximately $\frac{1}{4}$ wave length. Use of circular isolating decoupling chokes 32 (FIG. 2*b*) in the vicinity of the GPS antenna reduce secondary lobing and should restrict the radiating currents to the zone of the radiating element, and the resulting patterns should resemble the isolated element patterns below the horizon and zenith.

The GPS requirement is for right-hand circular polarization. A 3 dB printed circuit decoupler 32 in the choke section 30 provides the necessary phase and amplitude inputs to the antenna to generate circular polarization in the far field. The polarization purity is a function of mechanical alignment of the radiating loops and the phase and amplitude balance in the coupler. In practice, the loop alignment does not become a factor since it is a machine part with tight mechanical tolerances. The relative phase of the output ports of 3 dB printed circuit decoupler 32 is in perfect quadrature over narrow band widths such as the GPS and amplitude imbalance is no more than 0.3 dB.

For GPS, although receiver protection is incorporated, consideration must be given to possible interference of the very low level GPS signals by the high power JTIDS and Tacan signals and their spurious output. For this reason, the present invention locates the JTIDS antenna below the Tacan antenna for additional attenuation of the JTIDS signals at the GPS antenna.

What is desired in the GPS antenna is a broad pattern with good circular polarization characteristics. From installation standpoint, the recommended "mast top" antenna is ideally suited for GPS. The adjoining surfaces can be tailored to shape the pattern by the use of cone sections and implementation of resonant and antiresonant chokes section 30.

In the illustrated configuration, the GPS antenna 14 is located above the Tacan antenna 16. This GPS antenna will incorporate a loosely coupled bicone 33 to improve elevation stability of the patterns with the bicone 33 being capped with a disc for mounting the GPS antenna elements of FIG. 3 and will simultaneously enhance isolation.

TACAN

Tactical Air Navigation

The Tacan antenna 16 is compact, light-weight and electronically scanned and offers advantages for multifunction use and is adaptable for incorporation in the illustrated integrated stacked design on a mast top 12 where it may be subjected to heavy wind and environmental loads. In a specific design Tacan is approximately one foot high and four feet in diameter.

The technique employed to achieve the characteristic 15 CPS and 135 CPS modulation component employs digital control of parasitic elements. A select number of parasitic elements 34 are arranged around the central monopole or radiator 36 and these parasites are digitally switched in a predetermined pattern. The parasitic elements are small dipoles which are effectively detuned by large inductances to prevent current flow. The outer array of parasitics 38 produce the 9th harmonic, 135 CPS fine bearing modulation. This electronically scanned Tacan antenna is available commercially from the Avionics Division of ITT, Nutley, N.J. 07110.

The solid-state Tacan antenna offered by ITT in its shipboard configuration consists of two major units: an antenna assembly and a control monitor. These units together with the shipboard becon, provide aircraft with distance and bearing information needed to determine their positions with respect to the ship. The antenna assembly is designed for installation at the top of a mast. The antenna consists of three major sub-assemblies: RF subassembly, pedestal, and an electronic subassembly. The RF sub-assembly is protected by a fiberglass honeycomb randome attached to a lower aluminum section by quick release fasteners. The RF subassembly has replaceable parasitic modules arranged in a circular pattern on an aluminum honeycomb sandwich counterpoise. The inner ring consists of replaceable 15 Hz modules arranged in a circle around a central radiator.

The basis of the non-rotating electromagnetic wave energy transmitting antenna is the Yagi array disclosed in U.S. Pat. No. 1,860,123 granted May 24, 1932. In a Yagi-type array, several parallel planar dipoles are present including, in order, a not-fed dipole called reflector, a fed dipole called driven dipole and a number of non-fed suitably spaced parasitic dipoles called directors. The Tacan antennas of the non-rotating type are further disclosed in U.S. Pat. No. 3,560,978 granted Feb. 2, 1971; U.S. Pat. No. 3,845,485 granted Oct. 23, 1974; U.S. Pat. No. 3,846,799 granted Nov. 5, 1974; U.S. Pat. No. 3,863,255 granted Feb. 2, 1971 and U.S. Pat. No. 4,014,024 granted Mar. 22, 1977.

The shipboard Tacan and JTIDS systems are configured to operate with independent timing but both systems occupy the same frequency band and therefore decoupling must be provided between the respective transmitters and receivers. This necessitates separate radiating apertures with appreciable RF coupling. Vertical stacking these antennas will permit achievement of the clear aperture requirements and provide isolation of 40 dB or more. Towards this end, circular decoupling chokes 40 are interposed between the Tacan and JTIDS sections and may assume any one of several suitable configurations similar to the isolation means 30.

A large discone radiator 42 (including the parasitic support counterpoise) in addition to supporting the decoupling section 30 forming part of GPS bicone 33 advantageously modifies the elevation pattern of the central monopole 36 to increase the horizontal gain and improve the elevation tracking of the spatial harmonic components.

JTIDS ANTENNA (Joint Tactical Information Distribution System)

The JTIDS is intended to be a joint service program aimed at developing a high capacity, jam resistant, secure communications, navigation and identification system. It will utilize a low duty signal structure sharing the Ld band with Tacan and other systems.

The JTIDS and Tacan antennas are required to radiate and receive vertically polarized signals over the same band of radio frequencies and, ideally, should possess similar or identical elevation patterns. For these reasons, the JTIDS and Tacan antennas are similar in design and JTIDS uses as its basis a modification of the new lightweight shipboard electronically scanned Tacan antenna developed by and commercially available from the Avionics Division of ITT, Nutley, N.J. 07110.

Thus, the JTIDS 18 antenna is excited with a centrally located monopole 44 which is loosely coupled to an upper cone structure forming part of the discone 46, the parasite supports which include counterpoise forming a large discone radiator with flare angle well below optimum for the equivalent horn size. The cone structure serves two useful purposes. First, it provides a convenience medium for installation of decoupling sections, and secondly, it modifies the elevation pattern of the central monopoles, in such a way, as to increase the horizontal gain and improve the elevation tracking of the spatial harmonic components generated.

With respect to the directional azimuth function potential for JTIDS, the discone design for JTIDS not only offers nearly ideal formation of elevation patterns, it also allows the incorporation of azimuth pattern shaping devices to improve system performance in the presence of jammers so as to enhance the signal levels to more distant cooperating terminals.

Implementation within the radiating structure consists of either an array of fed monopoles or ring arrays of parasitic elements 48 which are simply turned "on" or "off". Either closed loop adaptive techniques or more conventional control methods may be used for either implementations since all necessary position information is available.

With respect to azimuth plane pattern shaping for JTIDS, the basic antenna pattern requirements for the JTIDS antenna in the azimuth plane is an omni-directional pattern. This is readily attainable with the contemplated antenna configuration. However, the proposed antenna has capabilities which can be utilized to an advantage in specific circumstances where beam shaping, directive beams and signal exclusions are desired.

As previously stated, the Tacan antenna operates in the same band of frequencies as JTIDS. It generates and rotates an azimuth pattern function consisting of a single cycle and a nine cycle spatial variation of the signal amplitude. Utilizing the same techniques, other spatial harmonics could be generated and positioned in azimuth to produce an almost unlimited variety of patterns.

The capability of generating a wide variety of predictable pattern shapes across the band depends on the stability in both amplitude and phase of the reradiation from the switched parasites 48. The change in phase in turn is dependent upon the change in self-impedance of the parasites 48 and the change in electrical length of the excitation distance in the central feed element.

Because of frequency hopping in JTIDS it would be necessary to selectively activate different groupings of parasites, dependent upon the transmitted or received frequencies, to obtain a given directive pattern at all frequencies in the band. As an alternative, use of phase and amplitude compensated parasites could provide uniform pattern functions at all frequencies from a single grouping of active elements. From the standpoint of minimizing control complexity, a compensated parasite is needed which can provide good performance across the entire band.

With respect to parasite compensation for JTIDS, ideally a compensated parasite for this application would exhibit both constant amplitude and phase of the reradiated signal. For synthesizing patterns with deep minima, it is especially important to control the electrical phase of each harmonic. The total change in phase is the sum of the changes in self-impedance phase and the excitation phase resulting from the change in the electrical radius with frequency. The change in electrical radius is readily calculated by multiplying the radius by the fractional change in frequency. Furthermore, this change is always to delayed phase at higher frequencies.

For further details of the JTIDS antenna and parasitic compensation reference is made to pending application entitled "Antenna Pattern Synthesis and Shaping" filed on Nov. 9, 1978 under Ser. No. 959,395, now U.S. Pat. No. 4,260,994.

In an integrated antenna system isolation requirements must be examined to make sure that the performance of the system has not been degraded due to interference effects and to establish a margin of safety against receiver burn-out from high level signals. Control of transmission and receiving times is not necessarily the answer. The JTIDS system utilizes frequency hopping throughout the entire Tacan band so there will be times when the Tacan receiver will be subjected to "on channel" signals from the JTIDS transmitter and other less frequent times when the Tacan transmitter is responding while the JTIDS receiver is open at the same frequency. Since the Tacan receiver does not incorporate high power protection, it will be necessary to provide substantial decoupling of the antennas.

Minus 40 dB isolation can be achieved by incorporating multiple anti-resonant ring sections 40 between the two antennas. Neglecting line losses, this would reduce the "on channel" JTIDS signals at the Tacan receiver to about 150 mw peak. Although this level is considered safe, a low power limiter could be installed in the receiver line to insure an additional margin of safety. For the JTIDS receiver, 40 dB isolation results in reduction of the Tacan signals to one or two watts peak. Since JTIDS incorporates high power protection, no further devices are required at the receiver.

One of the most important aspects of the discones radiators is the improvement in pattern shaping obtained relative to the monopole over counterpoise antenna. With the monopole/over/counterpoise configuration the signal level increases monatonically from approximately −10 dB at −30° elevation to a peak of approximately +5.6 dB which occurs in the region of 25° to 30° elevation.

While the signal characteristics of the counterpoise type antenna have been shown to provide satisfactory shipboard service, the improved horizon gained together with the more uniform amplitude characteristics of the discone antenna will provide improved operational margins. As an added bonus, modification of elevation patterns for Tacan also results in substantial improvement in the modulation tracking for the 135 Hz bearing signals.

A lightning arrestor protector 50 has been designed for mounting in close proximity to the Tacan antenna 16. The design is such that it reradiates only a small fraction of the illuminating Tacan signal. The arrestor 50 consists of a rod 52 with many stacked $\frac{1}{3}$ wave length shorted sections 54 which appear as high impedances in series thus limiting the induced currents and resulting reradiation.

Some minor modification of this design may be required at its upper end to optimize its performance at the GPS frequencies. Towards this end, the arrestor upper portion would include sections of different $\frac{1}{4}$ wave length characteristics.

In the stacked antenna configuration of this invention any one of many suitable means may be employed for passing control cables for one section through the RF field of another section without grossly distorting the resulting pattern. For example, a coaxial feed system may be adopted utilizing $\frac{1}{4}$ wave length shorted sections at the bottom of the outer two feeds. Another system would entail parallel transmission cables run up through the stacked antenna sections with feed out being accomplished as needed by each section. Of course, an external peripheral feed arrangement may be used to the individual antenna sections. As will be readily apparent to those skilled in the art, a bottom feed system is available depending on the parameters and requirements of the multiple antenna arrangement and the individual sections thereof. However, it should be understood that the bottom feed of the transmission cables does not per se constitute part of the present invention.

Thus, the several aforenoted objects and advantages are most effectively attained. Although a single and somewhat preferred embodiment has been disclosed and described in detail herein, it should be understood that this invention is in no sense limited thereby and its scope is to be determined by that of the appended claims.

What is claimed is:

1. A stacked multiple antenna system in a single, lightweight, compact, integrated unit for a ship mast top comprising a predetermined number of stacked antennas constituting a single substantially hemispherically shaped mast mounted structure while achieving sufficient isolation between antennas to permit the individual antenna to run freely without the impairment of operation of each:

a first antenna capable of generating a first electromagnetic wave radiation pattern, the first antenna being a parasitic element array antenna and being a Joint Tactical Distribution System (JTIDS) antenna;

a second different antenna proximal to and in stacked relationship therewith, the second antenna being a parasitic element array antenna and being a Tactical Air Navigation (Tacan) antenna;

a third antenna different from the first and second antenna and being proximal to and in stacked relationship with the second antenna with the second antenna interposed between the first and third antenna, the third antenna being a receiver of navigational signals and being a Global Positioning System (GPS) antenna;

an isolation system for isolating the antennas from one another such that the antennas do not interfere with one another's operation, the isolation means including a first isolation means for isolating the first and second antenna from one another and a second isolation means for isolating the second and third antenna from one another.

2. The invention in accordance with claim 1 wherein the first antenna includes means for producing spatial radiation patterns for navigation communication and identification purposes.

3. The invention in accordance with claim 1 wherein the second antenna includes means for providing air bearing and navigation information.

4. The invention in accordance with claim 1 wherein the isolation means includes decoupling choke rings.

5. The invention in accordance with claim 1 wherein each antenna includes cone means for enhancing the selected radiation pattern characteristics.

6. The invention in accordance with claim 1, wherein lightning arrestor means is mounted in close proximity to the antenna system for providing protection therefor.

* * * * *